US005819837A

United States Patent [19]

Hugo et al.

[11] Patent Number: 5,819,837

[45] Date of Patent: Oct. 13, 1998

[54] PROCESS AND APPARATUS FOR MELTING AND CASTING OF METALS IN A MOLD

[75] Inventors: Franz Hugo; Jakob Huber, both of Aschaffenburg, Germany; Robert Y. Abramson, Stonington, Conn.; John Sheehan, Poway, Calif.

[73] Assignee: ALD Vacuum Technologies GmbH, Erlensee, Germany

[21] Appl. No.: 810,022

[22] Filed: Mar. 3, 1997

[30] Foreign Application Priority Data

Mar. 1, 1996 [DE] Germany ..... 196 07 805.9

[51] Int. Cl.[6] ..... B22D 27/15; B22D 35/04

[52] U.S. Cl. ..... 164/61; 164/136; 164/258; 164/493

[58] Field of Search ..... 164/136, 335, 164/493, 507, 256, 257, 258, 114, 289, 298, 61, 66.1

[56] References Cited

U.S. PATENT DOCUMENTS

| | | | |
|---|---|---|---|
| 2,787,536 | 4/1957 | Spedding et al. | 164/493 |
| 3,977,462 | 8/1976 | Ohara | 164/256 |
| 4,580,617 | 4/1986 | Blechner et al. | 164/493 |

FOREIGN PATENT DOCUMENTS

| | | | |
|---|---|---|---|
| 1262521 | 9/1960 | Germany . | |
| 1238162 | 4/1967 | Germany | 164/136 |
| 1558159 | 3/1970 | Germany . | |
| 2500521 | 12/1975 | Germany . | |
| 2-307651 | 12/1990 | Japan | 164/507 |
| 1759542 | 9/1992 | U.S.S.R. | 164/136 |

OTHER PUBLICATIONS

Kreutzer, "Induktiv beheizter Vakuum–Bruckguss Eine zukunftsichere Gusstechnik", Dental–labor, XXXIV, Heft Dec. 1986 1927–1929.

*Primary Examiner*—Kuang Y. Lin
*Attorney, Agent, or Firm*—Fulbright & Jaworski

[57] ABSTRACT

Metal is melted in an induction-heated crucible (13) on which a mold (10) with a downward-facing filling opening (26) is located in the melting position. After melting the metal, the crucible (13) and the mold (10) are jointly rotated about a horizontal axis (A—A) into a tilting position in which the molten material flows from the crucible (13) into the mold (10). In order to melt reactive metals, melting is done in a crucible (13) that is surrounded by a vacuum, this crucible being surrounded by an induction coil (15) outside of the vacuum. The mold (10) is located in a vacuum-sealed casting chamber (6) which is evacuated together with the crucible (13) prior to melting and casting is carried out by a joint tilting of the crucible (13), casting chamber (6) and mold (10) by at least 180 degrees while the vacuum is maintained.

20 Claims, 3 Drawing Sheets

Fig. 1
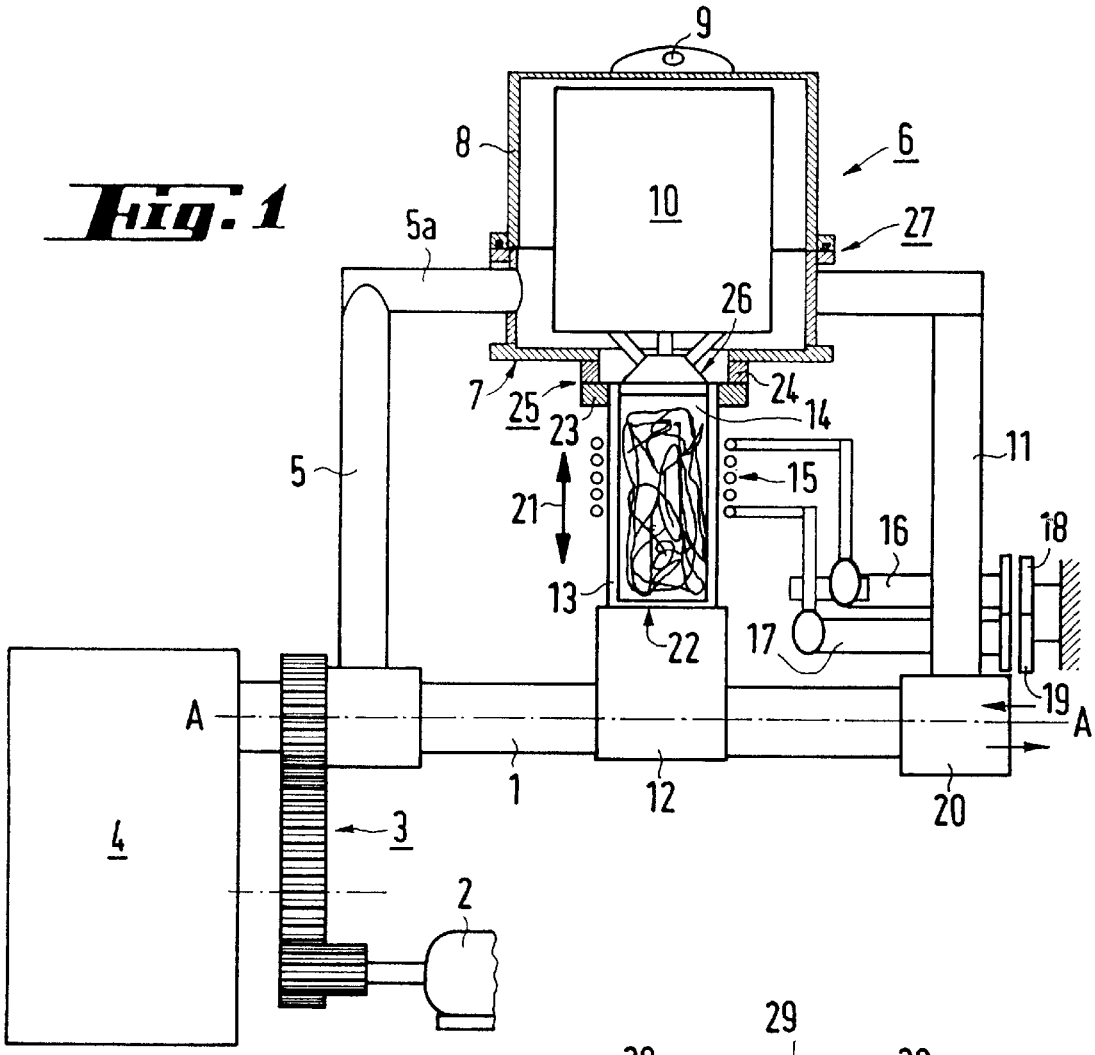
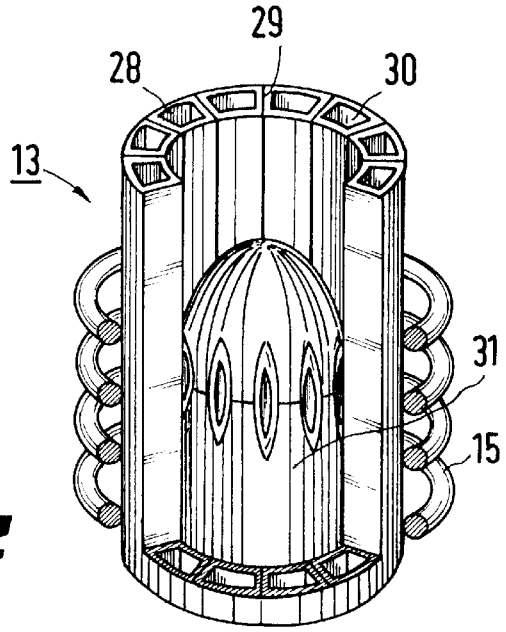
Fig. 2

PROCESS AND APPARATUS FOR MELTING AND CASTING OF METALS IN A MOLD

BACKGROUND OF THE INVENTION

The invention concerns a process for melting and casting metals in molds wherein the melting takes place in a heated crucible on which a mold with a filling opening facing downwards is located. After the melting of the metal, the crucible and the mold are rotated about a horizontal swiveling axis into a tilting position in which the melted material flows from the crucible into the mold.

An apparatus for such a process is known as a "roll-over furnace" wherein a ceramic mold is placed onto a ceramic crucible which is surrounded by an induction coil. In the melting position, the crucible is located underneath and the mold is put onto the crucible with its filling opening facing downwards. After the melting of the batch the entire apparatus is inverted like an egg timer so that casting into the mold can take place. The known apparatus has proven quite useful for materials which do not react or react only lightly with atmospheric oxygen; however, for materials which react with atmospheric oxygen at their melting temperatures, this known device and the process used are not useful.

Furthermore, it is already known to locate a tilting crucible in a stationary or tiltable vacuum chamber and to pour the melted material into molds from the crucible, the molds being successively brought into and out of the same vacuum chamber or a connected vacuum chamber. The known device has an extraordinarily large volume and has proven itself impractical both in terms of investment costs as well as is in terms of operating costs.

To carry out the process in a stationary vacuum chamber would require a very large volume due to the large tilting range of the crucible and mold. In case of a batch operation this would result in unacceptable cycle times since the evacuation of such a large vacuum chamber consumes a significant amount of time.

Based on the article by Kreutzer "Induktiv Beheizter Vakuum-Druckguss-Eine Zukunftssichere Gusstechnik", published in "dental-labor", XXXIV, issue 12 (1986), pages 1927 to 1929, it is known to degas metal melt under a vacuum, to empty it into mold by tilting a crucible by 80 degrees and to compress the casting by means of excess pressure. The process and the device are intended for dental castings, therefore for very small parts, and no information is provided regarding the location of the induction coil and a special connection between crucible and mold.

From DE 15 58 159 AL it is known to carry out the melting and casting in an evacuated tube which, in the area of a crucible and a loose stack of molds, is surrounded by induction coils. The device is not intended nor suitable for tilting since the crucible is emptied into molds via an opening in the bottom.

From DE 12 62 521 C it is known to locate a melted part in vertical, stationary arrangement between a charging lock and a mold room with a carousel for several molds while locating additional vacuum locks in between. An induction coil and a crucible are located within the vacuum. Investment, operating and maintenance costs as well as the volume and the weight of the design are significant and the evacuation times are correspondingly long. The device is not intended nor suitable for casting using a tilting process. The casting occurs by coupling the molds to an opening in the bottom of the crucible. The necessary lifting motor for this process is also costly.

From DE 25 00 521 a similar type of process and device are known whereby a crucible and a mold are located in a single mold cavity in a joint vacuum chamber and connected so that the filling opening of the mold is located at an angle of 90 degrees to the crucible axis. The vacuum chamber is located in an attachment plate by means of a high shaft end wherein the turning angle is limited to 90 degrees by means of stoppers. A flexible vacuum line goes through the shaft end which has a smaller cross section and also only allows a limited tilting angle. The crucible is heated by means of an arc by two electrodes whose axes coincide with the crucible axis. This makes it impossible to coaxially connect the crucible and the filling opening so that the crucible cannot be brought into an overhead position for casting. The melting output with such an electrode arrangement is relatively small. By increasing the pressure it becomes possible to increase the density of the cast part, but the known device is neither intended nor suitable for spin casting which would increase density even more. It is also only intended for producing a single small cast part, namely a dental part.

SUMMARY OF THE INVENTION

According to the invention, large cast parts and/or a large number of parts can be produced at the same time from reactive materials under a vacuum, and they can be produced with time savings without interrupting the vacuum.

According to the invention, the initially described process is augmented as follows:

a) joint evacuation of mold and crucible, b) subsequent inductive melting in the crucible by means of an induction coil located outside of the vacuum, and c) casting by jointly tilting the crucible, casting chamber, and mold by at least 180 degrees while maintaining the vacuum.

According to the invention, the space to be evacuated is as small as possible so that short evacuation and cycle times for casting a batch can be achieved. A reaction of the melted material and/or the cast parts with atmospheric oxygen is not possible. The tilting angle of at least 180 degrees allows a clean and complete pouring of the melt and pore-free filling of the mold.

Of course it is also possible with such a process to cast such metals and alloys which do not or only slightly react with atmospheric oxygen at melting temperature. The process according to the invention is therefore a universally usable process for extraordinarily different metals and alloys.

The invention defines a very specific design and mode of operation for which there are the following alternatives. The crucible subject to vacuum can consist of rods that can be cooled which have insulation spaces therebetween and which are subject to the changing magnetic field of an induction coil. Such a crucible is also referred to as a "cold-wall crucible". The sealing to generate the vacuum can take place in two ways. On one hand, the rods that can be cooled can be surrounded by an insulating cover, on the other hand it is possible to fill the insulation spaces between the rods that can be cooled gas-impermeably with insulation material so that the cold-wall crucible becomes vacuum-sealed. Such cold-wall crucibles are known-in and of themselves—and have been described in the article by A. Gubchenko/Novikov/Choudhury/Hugo "Vacuum Induction and Induction Plasma Furnaces with Cold Crucible", published in "Proceedings Vacuum Metallurgy Conference, 1991, Pittsburgh, USA", pages 15 to 20.

Alternatively, it is also possible to locate a hot-wall crucible made from ceramic materials in an insulation tube which consists, for example, of quartz or a fibre-reinforced plastic which is cooled on its interior side. Such an insulation tube allows the passage of electromagnetic waves and can therefore be surrounded on its outer side by the necessary induction coil. Especially the so-called "quartz tube heater" have been state-of-the art for a long time, but so far they have not been used for this purpose.

The encapsulation of crucible and mold provides the benefit that inert gas can be induced into the crucible when it is in the casting position and this creates an increase in pressure above the filling opening of the mold. Due to the existing pressure difference between this gas pressure and the vacuum present on the outer side of the mold or the molds the melt is pressed into the cavity of the mold or molds not only due to gravity, but also due to the given pressure difference so that a pore-free casting with a dense and smooth surface is created.

According to an optional process variation the crucible, induction coil, casting chamber and mold are subjected to a spin casting motion which is carried out at sufficiently high RPM that the centrifugal force in the overhead position of the mold significantly exceeds acceleration due to gravity. During the melting of lower-density material it is preferable to move the induction coil in the direction of the bottom of the crucible during the melting.

The invention also concerns an apparatus for melting and casting of metals in molds under vacuum with a heatable crucible that has an open end. The crucible is connected with a mold which has a filling opening whereby crucible and mold can be tilted jointly around a horizontal swiveling axis into a tilting position in which the melt can be transferred from the crucible into the mold.

The apparatus according to the invention is characterized by the following features:

a) the mold is located in a vacuum-sealed casting chamber and is located with its downward-facing filling opening in the melting position on the open end of the crucible, b) the open end of the crucible is surrounded by a flanged edge which forms a gas-impermeable flange connection with the casting chamber, c) the crucible is surrounded by an induction coil outside of the vacuum, and d) the crucible, induction coil, casting chamber and mold can be rotated together by at least 180 degrees by means of a hollow shaft.

Such a device represents the smallest possible "design volume"and therefore leads to low investment and operating costs. The additional related advantages were already pointed out above.

In doing so it is particularly advantageous if the mold is made of a porous material, and/or the casting chamber is connected by a vacuum suction lines with the hollow shaft which encompasses the rotation axis and is connected to a vacuum pump by means of a rotation coupling.

The last mentioned characteristic is of particular advantage for the following reason. A vacuum suction line for metallurgic processes generally requires a sizeable cross-section. Designing a part of the vacuum suction line as a hollow shaft facilitates a very rigid and low-vibration design with a relatively low wall thickness of the hollow shaft. The hollow shaft can be connected with the vacuum pump or with a set of vacuum pumps in a very simple manner.

It is additionally advantageous if the hollow shaft consists of two coaxial hollow shaft sections between which the crucible is located, where one of the hollow shaft sections is connected to the vacuum pump and the other hollow shaft section contains coolant lines for at least one of the devices such as crucible, induction coil and casting chamber.

This design specification results in a solution wherein at least most of the necessary lines are protected in the hollow shaft sections.

It is also advantageous if the casting chamber has a flanged edge which forms a first gas-impermeable flange connection with the flanged edge of the crucible and a second flange connection for the creation of a removable lid of the casting chamber, where the vacuum suction line is connected to the casting chamber between the first and the second flange connection.

This design offers the advantage that the vacuum connection between the hollow shaft and the casting chamber does not have to be interrupted. This also creates the possibility that a part of the vacuum suction line can be used as a supporting element for the casting chamber which will be referred to later.

Three examples of the invention are explained in more detail subsequently, using FIGS. 1 to 4.

FIG. 1 is a partially sectioned schematic side view of a first embodiment,

FIG. 2 is a cut-away perspective of a state-of-the-art cold-wall crucible,

DETAILED DESCRIPTION OF THE PREFERRED EMBODIMENT

Figure 3:
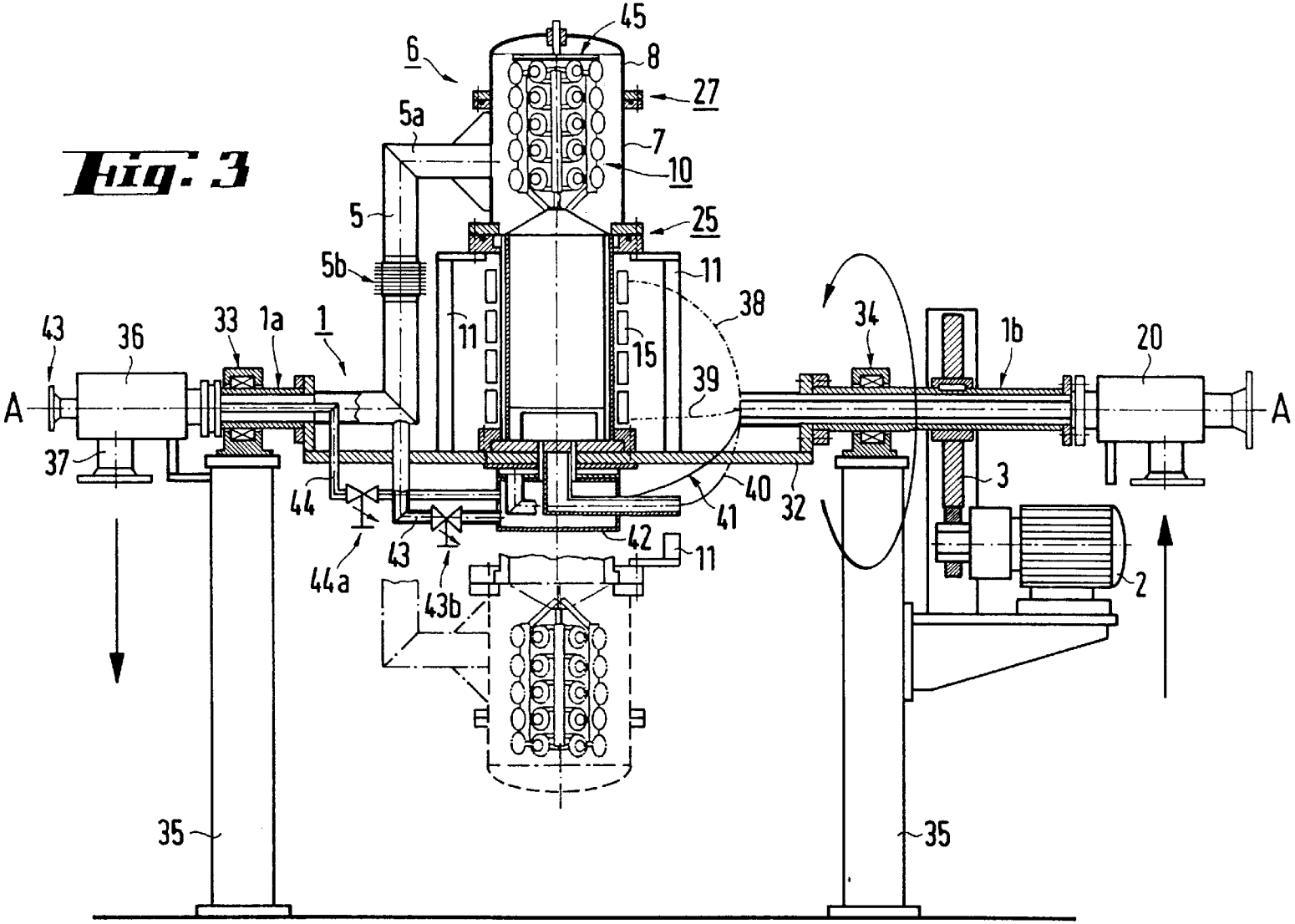
FIG. 3 is a partial axial section view through a production facility according to a second embodiment.

In FIG. 1 a hollow shaft 1 is illustrated which concentrically surrounds a rotation axis A—A. The hollow shaft 1 is driven by an electric motor 2 and a transmission 3 wherein motor 2 also acts as a stepping motor which is capable of setting a very exact position of hollow shaft 1 as well as to bring this hollow shaft into a very rapid rotation for the spin casting process. The open end of hollow shaft 1 is connected through a known revolving joint with a set of vacuum pumps 4. From hollow shaft 1, which also represents a part of the vacuum suction line, an additional vacuum suction line 5 leads to a casting chamber 6 which consists of a main part 7 and a lid B. The lid 8 is equipped with a crane hook by means of which the lid can be lifted and returned in order for charging and removing a mold 10 which has only been drawn schematically. The vacuum suction line 5 runs radially to rotation axis A-A and on the opposite side of casting chamber 6 it is connected with hollow shaft 1 with a supporting element 11 which is also located radially.

Hollow shaft 1 has a middle part 12 on which a crucible 13 is attached whose interior space 14 is sealed against the vacuum by means of one of the above mentioned measures. The crucible 13 is surrounded by an induction coil 15 whose leads 16 and 17 are attached to the supporting element 11. The leads 16 and 17 are connected with stationary contacts 18 and 19 in a detachable manner so that crucible 13 can be heated in the illustrated melting position.

The supporting element 11 is also connected with the hollow shaft 1 which at this end has a rotation coupling 20 for bringing in and removing cooling water which is indicated by the two arrows pointing in opposite directions. The corresponding coolant lines are located inside of hollow shaft 1.

A double arrow 21 indicates that induction coil 15 can be moved in the direction of the longitudinal axis of the crucible 13, therefore in a radial direction with respect to the axis of rotation. This movement is useful when the interior space 14 is filled with coarse parts with low filling density, for example with scrap metal. In this case, melting is started at the upper crucible end and the induction coil is lowered in the direction of the bottom 22 of the crucible as the melting process progresses since the entire melt is located there after the melting process is completed.

The open end of the crucible 13 is surrounded by a flanged edge 23 on which a complementary flanged edge 24 of casting chamber 8 can be placed in a vacuum-tight manner. This creates a first flange connection 25. A filling opening 26 of mold 10 is supported on the upper edge of the crucible 13, this opening is facing downwards in the illustrated melting position. The casting chamber 6 has a second flanged connection 27 between the main part 7 and the lid 8. One can see that the vacuum suction line 5 is connected to the casting chamber 6 by means of an interim piece 5*a* between the two flange connections 25 and 27.

For better understanding FIG. 2 shows a so-called "cold-wall crucible" as it is described in the above-mentioned literature. Such a crucible 13 consists of hollow, coolable rods 28 which are located in a circle similar to palisades with insulating spaces 29 between them. In the insulating spaces 29 there is a hardened insulating material so that vacuum-impermeability is present. Rods 28 have a cavity 30 which is connected to a coolant circulation. Crucible 13 is surrounded by the induction coil 15 already described which generates longitudinal flows in rods 28 which contact melt 31 on their lower part. This has a repelling effect on melt 31 so that the surface of the melt takes on the shape of an inverted paraboloid.

The cold-wall crucible in accordance with FIG. 2 is particularly suitable for melting and casting of metals and alloys which must under no circumstances be contaminated by ceramic particles and which therefore must not come into contact with the ceramic materials of hot-wall crucibles. An example is the production of turbine blades.

In case of the design example according to FIG. 3, identical parts and parts with identical functions are identified with the same reference numerals as FIG. 1. In this case the hollow shaft 1 consists of two coaxial hollow shaft sections 1*a* and 1*b* between which the crucible is attached whereby it is ensured that the crucible bottom 21 is located in or above the rotation axis A—A so that no melt remains on the crucible bottom during spin casting. Support/beam 32 is connected with the casting chamber 6 by means of supporting elements 11. Support/beam 32 is located in pivot bearings 33 and 34 by means of the two hollow shafts 1*a* and 1*b*, these pivot bearings are located on columns 35 in order to create the necessary "leg room" for the rotation movement of the casting chamber 6.

The left hollow shaft section la is connected to a vacuum pump (not illustrated here) through a rotation coupling 36 and a pipe connection 37. The right hollow shaft section 1*b* contains coolant lines 38, 39 and 40 for crucible 30, induction coil 15 and, if applicable, casting chamber 6 as well.

The left hollow shaft section la also serves as a vacuum suction line whose partial section 5 is connected similarly as in FIG. 1 through a connection line 5*a* to the casting chamber 6. In this case, however, the vacuum suction line does not serve as a supporting element for casting chamber 6. In order to avoid a mechanical interference of parts a compensator 5*b* is located in the vacuum suction line 5.

Below the crucible bottom 22 there is a housing 42 which is connected by a line 43 to a vacuum suction line 5. An additional gas line 44 which is likewise brought through the hollow shaft section 1*a* opens into an intermediate space in housing 42. Through lines 43 and 44 it is alternately possible to build up pressure or a vacuum downstream from the crucible bottom 22 or in the crucible 13, in order to, for example, exert static pressure on the melt above the opening 26.

If no spin casting is to be carried out with the apparatus it is possible to replace the drive unit consisting of electric motor 2 and transmission 3 with a hydraulic cylinder.

The following operating process is carried out with apparatus according to FIG. 1. For purposes of charging, the apparatus is located in the illustrated positions. Lid 8 is lifted off with a crane or another lifting device and the crucible 13 is filled from above. Subsequently mold 10, which can consist of numerous individual molds (see FIG. 3), is placed on the crucible 13 or onto an abutment not illustrated with the filling opening 26 facing downwards, and lid 8 is placed on top and the flange connection 27 is sealed.

Subsequently the entire device is evacuated and as soon as a specified pressure is reached the power supply to the induction coil 15 is turned on. The melting process can take place according to a specified temperature profile which is determined empirically. As soon as the specified melting temperature is reached the power supply is interrupted, feed lines 16 and 17 are separated from contacts 18 and 19 (not illustrated in FIG. 3), and the entire device is brought into the overhead position which causes the melt to flow into the mold 10 or into the molds.

As already stated earlier, this process can very effectively be supported by building up gas pressure above the surface level of the melt. After observing a sufficient cooling down period, the device is tilted back into the positions shown in FIG. 1 and 3 and after lifting lid 8 off, the mold 10 can be removed and the apparatus can be recharged.

Figure 4:
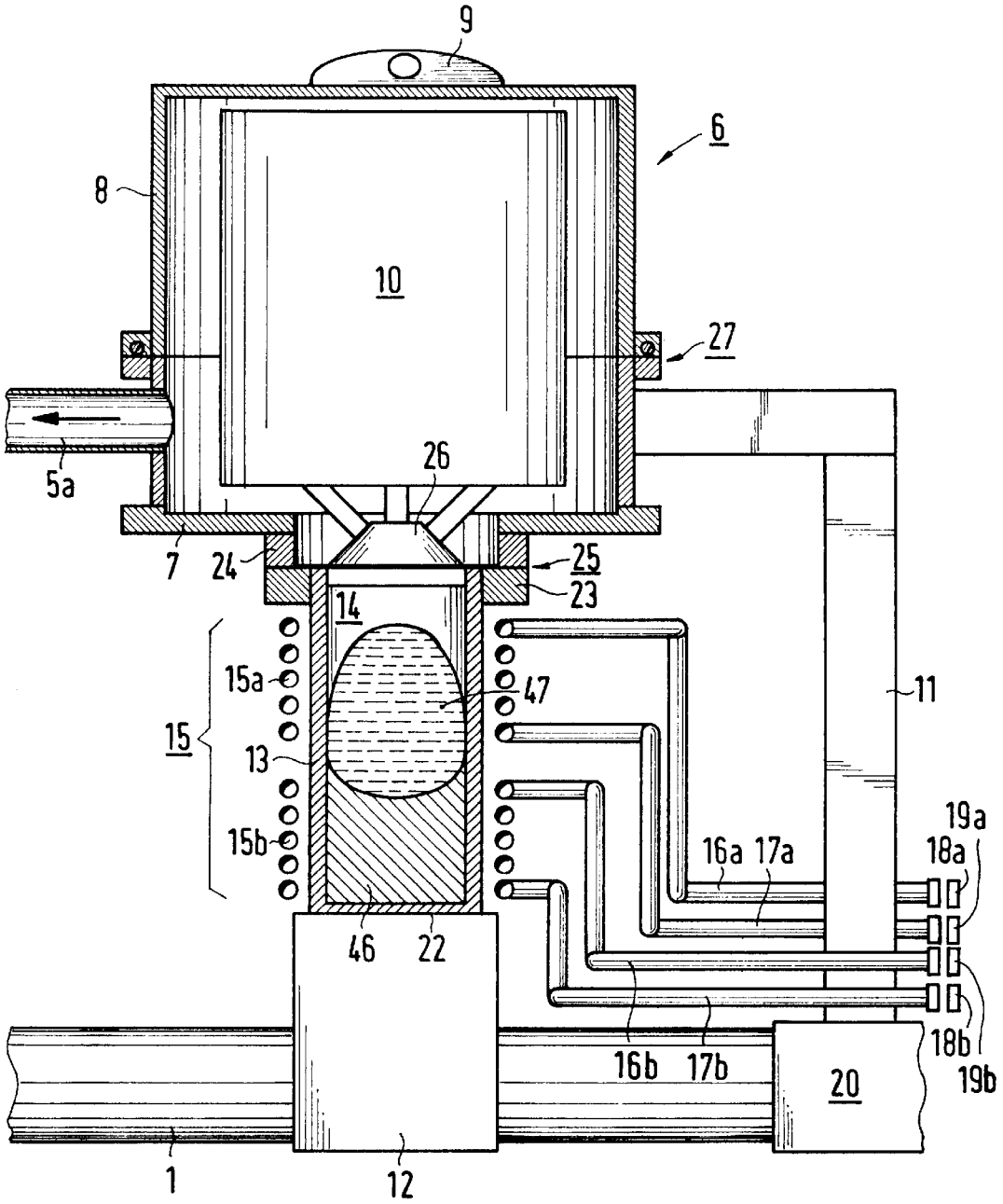
FIG. 4 is a partially sectioned schematic side view of a third embodiment.

FIG. 4 is an enlarged section of FIG. 1 retaining the reference numbers, but with the following changes:

The induction coil 15 is divided into two subcoils 15*a* and 15*b* which are on the circumference of the crucible 13 in fixed relationship to the latter, but are separated galvanically from one another. They can also be operated in common by electrical circuitry, e.g., in series or in parallel. By the sequential energizing of subcoils 15*a* and 16*a* from the top downward, the operating process described above can also be performed, in which a single but displaceable coil is present (double arrow 21 in FIG. 1).

In the case represented the upper subcoil 15*a* is connected to two feeders 16*a* and 17*a* which, when in the illustrated melting position, i.e., stationary, are connected to fixed contacts 18*a* and 19*a*. The lower subcoil 15*b* is connected to two feeders 16*b* and 17*b* which are connected to the fixed contacts 18*b* and 19*b*. The connection of the fixed contacts to separate power supply systems is not shown, since such measures are known. The feeders 16*a*, 16*b* and 17*a*, 17*b* are fastened to the supporting element 11 and can rotate with the entire apparatus when the contacts are opened.

This makes possible the following manner of operation: First, the material charged into the inner chamber 14 is completely melted by the simultaneous or sequential operation of the two subcoils 15*a* and 15*b*, whereupon at least the bottom part of the melt is solidified to an ingot 46 by shutting off the lower subcoil 15*b*.

This part of the charge forms a very effective thermal insulation against the crucible bottom 22. The upper part of the charge remains molten as melt 47, or it is remelted by the influence of the upper subcoil 15*a*. It is thus possible to proportion the melt to the outflow, that is, in a ratio of 50:50 in the case represented.

If now the apparatus is tilted 180° from the operational state represented in FIG. 4, i.e., it is put in the upside down position, only the molten portion 47 flows into the mold 10, and the ingot 46 forms the stock for the next cast using a new mold 10. As soon as this mold is placed on the crucible, the ingot 47 is melted by the lower subcoil 16*b* and teemed in a similar manner. The crucible content is then twice as great as the sum of all cavities of the mold 10. Thus, the working speed of the apparatus can be considerably increased. Due to the insulating effect of the ingot 46, which can also be called the "skull," the specific consumption of melting energy is considerably reduced.

If three coils are used the charge can be cast in three portions, etc.

We claim:

1. Process for melting and casting metal, said process comprising providing a crucible having an open end and a bottom, said crucible having therein a metal to be melted, providing a casting chamber having a surrounding wall and a downward facing opening, said casting chamber having therein a mold made of a porous material, providing a hollow shaft rotatable about an axis of rotation, said hollow shaft rotatably bearing said crucible and said casting chamber, said hollow shaft being a suction line having one end connected to a vacuum pump and another end communicating with said casting chamber via a first additional suction line, and with a housing below said crucible bottom via a second additional suction line with a valve therein, for evacuation of said crucible and said casting chamber so as to provide a vacuum atmosphere in said crucible and in said casting chamber, placing said casting chamber with said opening sealingly on said open end of said crucible, jointly evacuating said crucible through said hollow shaft and said second additional suction line and said housing below said crucible bottom and, said casting chamber, and said mold through said hollow shaft and said first additional suction line and said porous mold material, inductively melting said metal in said crucible by means of an induction coil located outside said vacuum atmosphere, and jointly tilting said crucible, said casting chamber and said mold by said hollow shaft through an angle of 180 degrees about a horizontal axis to a casting position so that said metal pours from said crucible into said mold while maintaining vacuum.

2. Process as in claim 1 wherein said crucible is evacuated through the wall of the casting chamber.

3. Process as in claim 1 further comprising introducing argon into the crucible while said crucible is in the casting position.

4. Process as in claim 1 further comprising spinning said crucible, said casting chamber, and said mold as a unit after pouring said metal into said mold.

5. Process as in claim 1 wherein said metal in said crucible is melted by moving said coil downward.

6. Process as in claim 1 wherein said induction coil is divided into an upper subcoil and a lower subcoil, said metal being melted by first turning on said upper subcoil followed by turning on said lower subcoil.

7. Process as in claim 1 wherein said induction coil is divided into an upper subcoil and a lower subcoil, said metal being melted by both subcoils followed by turning off said lower subcoil so that metal in a lower portion of the crucible solidifies.

8. Apparatus for melting and casting of casting of metal, said apparatus comprising a crucible having a bottom and an open end surrounded by a flange, an induction coil surrounding said crucible, a casting chamber having a surrounding wall and a downward facing opening surrounded by a flange which is placed sealingly against the flange of the crucible, a mold made of a porous material located inside said casting chamber, said mold having a filling opening facing said open end of said crucible, means for evacuating said crucible, said casting chamber, and said mold when said flange of said casting chamber is sealingly against said flange of said crucible, and means including a hollow shaft rotatable about a horizontal axis for rotating said crucible, said induction coil, said casting chamber, and said mold through at least 180 degrees to a tilted casting position, said hollow shaft rotatably bearing said crucible and said casting chamber, said hollow shaft being a suction line having one end connected to a vacuum pump and another end communicating with said casting chamber via a first additional suction line, and with a housing below said crucible bottom via a second additional suction line with a valve therein, for evacuation of said crucible and said casting chamber so as to provide a vacuum atmosphere in said crucible and in said casting chamber.

9. Apparatus as in claim 8 wherein said mold consists of a porous material.

10. Apparatus as in claim 8 wherein said means for evacuating comprises a vacuum suction line connected to said hollow shaft, and a vacuum pump connected to said hollow shaft by means of a rotation coupling.

11. Apparatus as in claim 10 wherein said hollow shaft comprises two coaxial hollow shaft sections between which said crucible is located, one of said sections being connected to said vacuum pump by means of said rotation coupling, the other section containing coolant lines for at least one of said crucible, said induction coil, and said casting chamber.

12. Apparatus as in claim 11 further comprising a gas line connected to said crucible through one of said hollow shaft sections.

13. Apparatus as in claim 11 further comprising a support beam fixed said hollow shaft sections and said crucible, and supporting elements fixed to said support beam for holding the casting chamber.

14. Apparatus as in claim 8 wherein said casting chamber comprises a removable lid which is fixed to said chamber by a gas impermeable flange connection.

15. Apparatus as in claim 8 further comprising a drive unit connected to said hollow shaft for spinning said crucible, said induction coil, said casting chamber, and said mold as a unit.

16. Apparatus as in claim 8 wherein said induction coil is movable axially with respect to said crucible.

17. Apparatus as in claim 8 further comprising connection contacts which can be decoupled from said induction coil when said crucible is rotated.

18. Apparatus as in claim 8 wherein said crucible is a sealed cold-wall crucible comprising coolable metal rods separated by insulating gaps and surrounded by said top flange.

19. Apparatus as in claim 8 wherein said crucible is a sealed hot wall crucible of ceramic material which is permeable to electromagnetic radiation from said induction coil.

20. Apparatus as in claim 8 wherein said induction coil is divided into at least two subcoils which can be energized independently.

* * * * *

UNITED STATES PATENT AND TRADEMARK OFFICE

CERTIFICATE OF CORRECTION

PATENT NO. : 5,819,837

DATED : October 13, 1998

INVENTOR(S) : Hugo et al.

It is certified that error appears in the above-identified patent and that said Letters Patent is hereby corrected as shown below:

In column 1, line 30, delete the word "is".
In column 3, line 50, insert a hyphen before the word "the" to read as - - - the - -.
In column 3, line 51, insert a hyphen before the word "the" to read as - - - the - -.
In column 4, line 44, change "Lid B" to read as - - Lid 8 - -.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*